US005494223A

United States Patent [19]

Hall et al.

[11] Patent Number: 5,494,223

[45] Date of Patent: Feb. 27, 1996

[54] FUEL INJECTOR HAVING IMPROVED PARALLELISM OF IMPACTING ARMATURE SURFACE TO IMPACTED STOP SURFACE

[75] Inventors: Bryan C. Hall, Newport News; Ray T. Wildeson, Yorktown; David P. Wieczorek, Newport News; Gordon H. Wyant, Hampton; Debora E. Nally, Williamsburg, all of Va.

[73] Assignee: Siemens Automotive L.P., Auburn Hills, Mich.

[21] Appl. No.: 292,454

[22] Filed: Aug. 18, 1994

[51] Int. Cl.[6] ..... F02M 51/00

[52] U.S. Cl. ..... 239/585.5; 251/129.21

[58] Field of Search ..... 239/585.1–585.5; 251/129.21, 129.18, 129.15

[56] References Cited

U.S. PATENT DOCUMENTS

| | | | |
|---|---|---|---|
| 4,915,350 | 4/1990 | Babitzka et al. | 239/585.4 X |
| 4,984,744 | 1/1991 | Babitzka et al. | 239/585.4 |
| 5,143,301 | 9/1992 | Reiter et al. | 239/585.4 |
| 5,165,656 | 11/1992 | Maier et al. | 239/585.4 X |
| 5,178,362 | 1/1993 | Vogt et al. | 239/585.1 X |
| 5,190,221 | 3/1993 | Reiter | 239/585.1 X |
| 5,217,204 | 6/1993 | Maier et al. | 251/129.21 X |
| 5,232,166 | 8/1993 | Reiter | 239/585.4 |
| 5,236,174 | 8/1993 | Vogt et al. | 239/585.4 X |
| 5,275,341 | 1/1994 | Romann et al. | 239/585.4 |
| 5,301,874 | 4/1994 | Vogt et al. | 239/585.4 |
| 5,360,197 | 11/1994 | Reiter et al. | 239/585.4 X |
| 5,383,606 | 1/1995 | Stegmaier et al. | 239/585.1 X |

*Primary Examiner*—Andres Kashnikow
*Assistant Examiner*—Lesley D. Morris
*Attorney, Agent, or Firm*—Russel C. Wells

[57] ABSTRACT

A non-ferromagnetic member is disposed between, and joined to, a ferromagnetic fuel inlet tube and a ferromagnetic valve body structure. The valve body structure is fitted to the non-ferromagnetic member by telescoping the upper axial end of the valve body structure over the O.D. of the lower end of the non-ferromagnetic member and by guiding the armature on a cylindrical guide surface in a bore of the valve body structure at a location that is axially below the axial location where the upper end of the valve body structure and the lower end of the non-ferromagnetic member telescopically engage. For given part tolerances and given tolerances in tooling that is used to assemble the parts, closer tolerance in parallelism of the impacting armature end surface to the impacted fuel inlet tube end surface is obtained.

14 Claims, 2 Drawing Sheets

FUEL INJECTOR HAVING IMPROVED PARALLELISM OF IMPACTING ARMATURE SURFACE TO IMPACTED STOP SURFACE

FIELD OF THE INVENTION

This invention relates to solenoid operated fuel injectors that are used in fuel injection systems of internal combustion engines.

BACKGROUND AND SUMMARY OF THE INVENTION

Typical solenoid operated fuel injector design comprises an armature that impacts a stop when the electromagnetic coil of the solenoid is energized. A valve element attached to the armature is unseated from a valve seat to open the fuel injector when the coil is energized. When the coil ceases to be energized, a mechanical spring forces the armature away from the stop, causing the valve element to become reseated and thereby close the fuel injector. The impacting surface of the armature and the impacted surface of the stop are typically chrome plated both for impact resistance and for providing a non-magnetic interface between otherwise ferromagnetic parts. More precise flatness and parallelism of the impacting and impacted surfaces will discourage wear and as a consequence maintain original factory-set valve lift longer since the onset of impact-wear-induced increases in valve lift that begin to significantly alter the original factory-set flow characteristic will be postponed due to decreased impact wear.

Parallelism between the impacting and impacted surfaces is a function of tolerance stack-ups of various assembled parts and of tolerances in tooling used to assemble the parts. In a top-feed fuel injector where the lower end of the fuel inlet tube is the impacted stop surface, its parallelism to the impacting surface of the armature also relies on the rigidity of the valve housing.

Recent trends toward fuel injectors that are smaller in overall diameter have caused the valve housing to be considered as one of the parts whose diameter can be reduced. A thinner walled housing can make a significant contribution toward overall diameter reduction, but it will require more extensive, and hence more costly, machining to maintain parallelism between impacting and impacted surfaces of the armature and the fuel inlet tube respectively.

The present invention relates to a novel construction for a fuel injector that seeks to maintain a desired degree of parallelism between these impacting and impacted surfaces in conjunction with a reduction in the fuel injector's overall diameter. The invention reduces the significance of tolerances in their effect on the desired parallelism so that components do not have to be more extensively machined in order to achieve the desired degree of parallelism. In general the invention relates to a novel construction for joining the ferromagnetic valve body (which may be a single piece or an assembly of several pieces) with the ferromagnetic stator by means of a non-ferromagnetic member. The invention is herein disclosed by way of example in a top-feed fuel injector where the fuel inlet tube forms the ferromagnetic stator which has an annular end face that provides the stop face that is impacted by the armature.

From patents such as U.S. Pat. Nos. 4,915,350; 4,984,744; 5,165,656; 5,178,362; 5,217,204; 5,232,166; and 5,236,174, it is known to join a ferromagnetic valve body to a ferromagnetic fuel inlet tube by means of a tubular non-ferromagnetic member that is welded at one end to the inlet tube and at the other end to the valve body. However, in those constructions, the lower end of the non-ferromagnetic member is telescoped over the outside of the ferromagnetic valve body, and the telescopically engaged portions are united by welding in the radial direction at a location on the non-ferromagnetic member that is axially located at about the midpoint of the telescopically overlapping portion of the non-ferromagnetic member. In some of these patents such as U.S. Pat. No. 5,217,204, axial guidance of the armature is provided by an axial I.D. surface of the non-ferromagnetic member, and not the valve body, so that parallelism of the impacting end surface of the armature to the impacted end surface of the inlet tube appears to be determined by controlling the tolerances of only the fuel inlet tube and the non-ferromagnetic member where they telescope together. In other of these patents, such as U.S. Pat. No. 4,915,350, axial guidance of the armature is accomplished by a so-called "slide bore" that is a part of the valve body, but that has an axial length that is short in comparison to the axial length of the armature. This so-called slide bore is at the upper end of the I.D. of the valve body, and the remainder of the valve body bore, within which the lower end portion of the armature is disposed, intentionally has a larger I.D. so that it deliberately provides no guidance of the armature. The location of this so-called slide bore is axially even with or axially above the axial location where the non-ferromagnetic member and the valve body are telescopically engaged.

The present invention comprises a construction that is distinguished from those of the aforementioned patents in that the valve body is fitted to the non-ferromagnetic member by telescoping the upper axial end of the valve body over the O.D. of the lower end of the non-ferromagnetic member and by guiding the armature on the I.D. of a cylindrical guide surface in the valve body bore at a location that is axially below the axial location where the upper end of the valve body and the lower end of the non-ferromagnetic member telescopically engage. For given part tolerances and given tolerances in tooling that is used to assemble the parts, closer tolerance in parallelism of impacting to impacted surfaces is obtained with the invention.

The invention will be described in full detail in the ensuing description and claims which are accompanied by drawings that disclose an exemplary presently preferred embodiment of the invention according to the best mode contemplated at the present time for carrying out the invention. Various features and advantages of the invention will more fully appear as the disclosure proceeds.

DESCRIPTION OF THE PREFERRED EMBODIMENT

Figure 1:
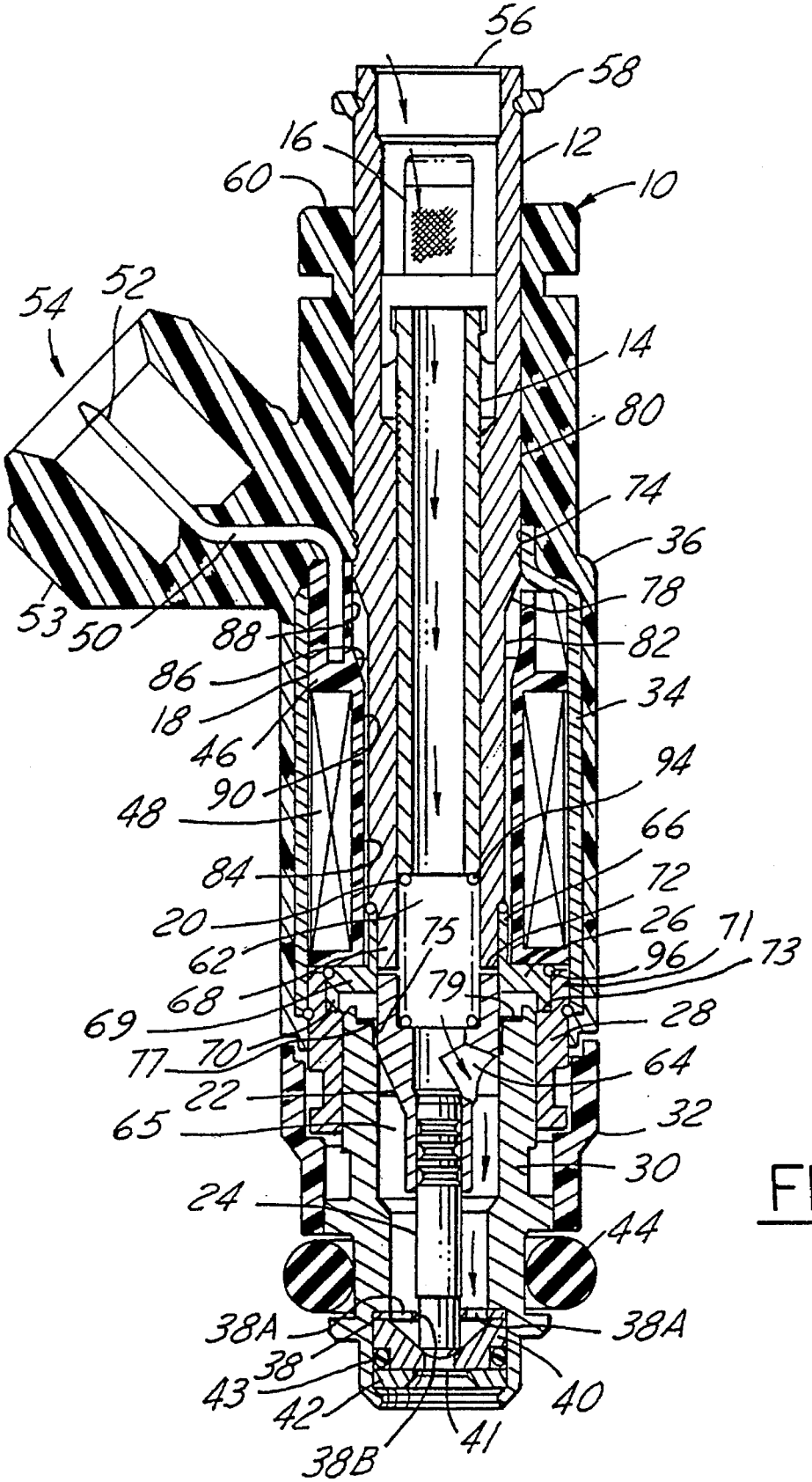
FIG. 1 is a longitudinal cross-sectional view through an exemplary fuel injector embodying principles of the present invention.

FIG. 1 shows an exemplary fuel injector 10 comprising a number of parts including a fuel inlet tube or stator 12, an adjustment tube 14, a filter assembly 16, a coil assembly 18, a coil spring 20, an armature 22, a needle valve 24, a stepped non-magnetic shell 26, a two piece valve body comprising a tubular first valve body part 28 and a tubular second valve body part 30, a plastic shell 32, a coil assembly housing 34, a non-metallic overmold cover 36, a needle guide member 38, a valve seat member 40, a thin disk orifice member 41, a backup retainer member 42, a small O-ring seal 43, and a large O-ring seal 44.

The needle guide member 38, the valve seat member 40, the thin disk orifice member 41, the backup retainer member 42 and the small O-ring seal 43 form a stack that is disposed at the nozzle end of fuel injector 10, as shown in a number of commonly assigned patents, such as U.S. Pat. No. 5,174,505. Armature 22 and needle valve 24 are joined together to form an armature/needle sub-assembly. Coil assembly 18 comprises a plastic bobbin 46 on which an electromagnetic coil 48 is wound. Respective terminations of coil 48 connect to respective terminals 50, 52 that are shaped and, in cooperation with a surround 53 formed as an integral part of cover 36, to form an electrical connector 54 for connecting the fuel injector to an electronic control circuit (not shown) that operates the fuel injector.

Fuel inlet tube 12 is ferromagnetic and comprises a fuel inlet opening 56 at the exposed upper end. A ring 58 that is disposed around the outside of fuel inlet tube 12 just below fuel inlet opening 56 cooperates with an end surface 60 of cover 36 and the intervening O.D. of tube 12 to form a groove for an O-ring seal (not shown) that is typically used to seal the fuel injector inlet to a cup, or socket, in an associated fuel rail (not shown). The lower O-ring 44 is for providing a fluid-tight seal with a port in an engine induction intake system (not shown) when the fuel injector is installed on an engine. Filter assembly 16 is fitted to the open upper end of adjustment tube 14 to filter any particulate material larger than a certain size from fuel entering through inlet opening 56 before the fuel enters adjustment tube 14.

In the calibrated fuel injector, adjustment tube 14 has been positioned axially to an axial location within fuel inlet tube 12 that compresses spring 20 to a desired bias force that urges the armature/needle such that the rounded tip end of needle valve 24 is seated on valve seat member 40 to close the central hole through the valve seat. Preferably, tubes 14 and 12 are crimped together to maintain their relative axial positioning after adjustment calibration has been performed.

After passing through adjustment tube 14, fuel enters a space 62 that is cooperatively defined by confronting ends of inlet tube 12 and armature 22 and that contains spring 20. Armature 22 comprises a passageway 64 that communicates space 62 with a passageway 65 formed by the bore of valve body part 30, and guide member 38 contains fuel passage holes 38A. This allows fuel to flow from space 62 through passageways 64, 65 to valve seat member 40. This fuel flow path is indicated by the succession of arrows in FIG. 1.

Non-ferromagnetic shell 26 is telescopically fitted on and joined to the lower end of inlet tube 12. Shell 26 has a tubular neck 66 that telescopes over a tubular neck 68 at the lower end of fuel inlet tube 12. Shell 26 also has a shoulder 69 that extends radially outwardly from neck 68. Shoulder 69 itself has a short circular rim 70 at its outer margin extending axially toward the nozzle end of the injector. Valve body part 28 is ferromagnetic; its upper axial end telescopes over the O.D. of rim 70 of non-ferromagnetic shell 26, and it is joined in fluid-tight manner to non-ferromagnetic shell 26, preferably by laser welding. FIG. 1 shows that the upper axial end of part 28 comprises a circular rim 71 that axially overlaps rim 70 at their telescopic engagement and an interiorly adjoining shoulder 73 that is in abutment with the free, downwardly facing annular end surface of rim 70.

The O.D. of the upper end of valve body part 30, which is a ferromagnetic part too, is telescopically received inside the I.D. of the lower end of valve body part 28, and these two parts are joined together in fluid-tight manner, preferably by laser welding at their telescopically overlapping regions intermediate the ends of the valve body part 30. Armature 22 is guided for axial reciprocation by a cylindrical guide surface 75 providing an I.D. at an upper portion of the bore through valve body part 30. While guide surface 75 could be a portion of the wall of the bore itself, FIG. 1 shows it to be part of a separate non-ferromagnetic eyelet 77 having a radially directed flange 79 that is attached to the upper end of part 30 and having surface 75 sized to a precise I.D. by a sizing operation. Additional axial guidance of the armature/needle sub-assembly is provided by a central guide hole 38B in member 38 through which needle valve 24 passes. It can be seen that the location where body part 30 guides armature 22 is axially below the location where parts 26, 28 are telescopically engaged.

In the closed position shown in FIG. 1, a small working gap 72 exists between the annular end face of neck 68 of fuel inlet tube 12 and the confronting annular end face of armature 22. The confronting ends are chrome plated to provide hardened abutment surfaces of non-ferromagnetic material between the otherwise ferromagnetic armature and fuel inlet tube.

Coil housing 34 and tube 12 are in contact at 74 and constitute a stator structure that is associated with coil assembly 18. Non-ferromagnetic shell 26 assures that when coil 48 is energized, the magnetic flux will follow a path that includes armature 22. Starting at the lower axial end of housing 34, the magnetic circuit extends through valve body part 28 and valve body part 30 and eyelet 77 to armature 22, and from armature 22 across working gap 72 to inlet tube 12, and back to housing 34. When coil 48 is energized, the spring force on armature 22 is overcome and the armature is attracted toward inlet tube 12 reducing working gap 72. This unseats needle valve 24 from seat member 40 to open the fuel injector so fuel is now injected into the engine's induction intake system from the injector's nozzle. When the coil ceases to be energized, spring 20 pushes the armature to close needle valve 24 on seat member 40.

Fuel inlet tube 12 is shown to comprise a frustoconical shoulder 78 that divides its O.D. into a larger diameter portion 80 and a smaller diameter portion 82. Bobbin 46 comprises a central through-hole 84 that has a frustoconical shoulder 86 that divides the through-hole into a larger diameter portion 88 and a smaller diameter portion 90. Shoulder 86 has a frustoconical shape complementary to that of shoulder 78.

FIG. 1 shows shoulders 78 and 86 to be axially spaced apart, and it also shows a portion of through-hole 84 and a portion of the O.D. of fuel inlet tube 12 to be mutually axially overlapping. That overlapping portion of through-hole 84 consists of shoulder 86 and a portion of the larger diameter portion 88 of the through-hole immediately above shoulder 86. That overlapping portion of the O.D. of tube 12 consists of shoulder 78 and a portion of the smaller diameter portion 82 of the tube. The significance of this will now become apparent upon consideration of FIGS. 2–4 which illustrate steps in the process of assembling coil assembly 18, fuel inlet tube 12, and parts 26 and 28.

Figure 2:
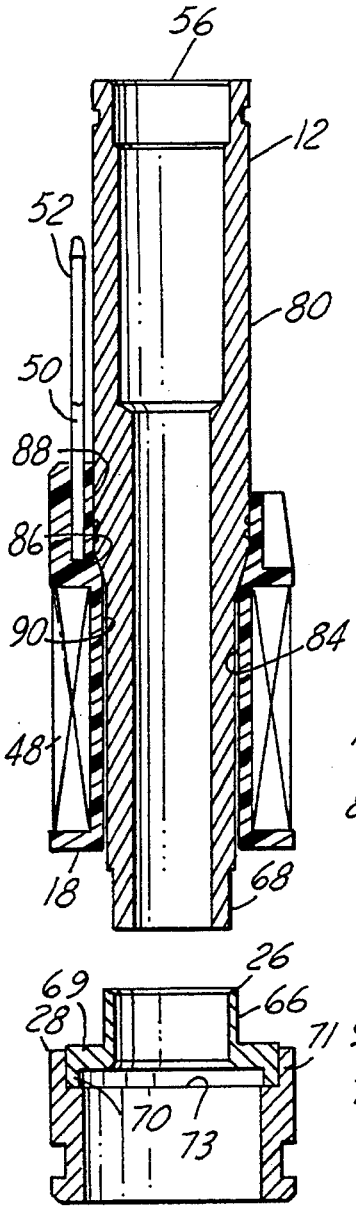
FIGS. 2, 3, and 4 are respective longitudinal cross-sectional views illustrating a sequence of steps occurring during one method of fabricating the fuel injector of FIG. 1.
Figure 3:
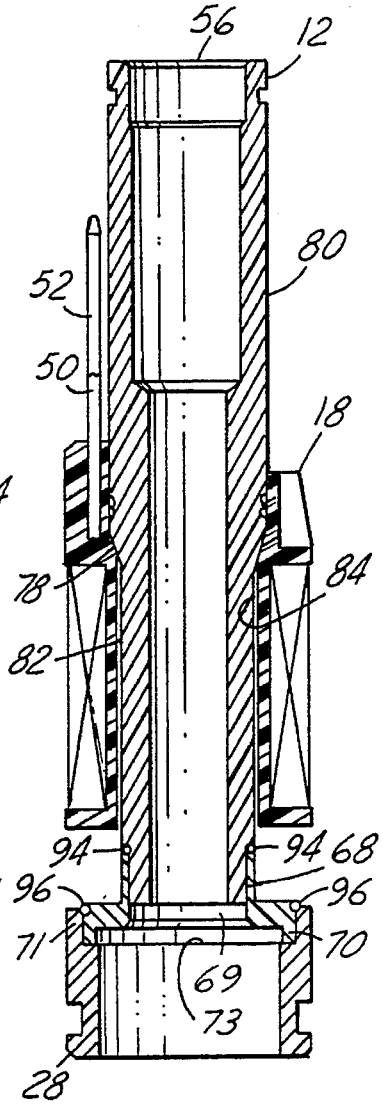

FIG. 2 shows the two parts 26, 28 to have already been telescopically fitted together and coil assembly 18 to have been disposed on tube 12. Terminals 50, 52 have not yet been formed to their final shapes. The disposition of coil assembly 18 on inlet tube 12 can be performed only by inserting the smaller diameter portion 82 into the larger diameter portion 88 of bobbin 46. FIG. 2 shows coil assembly 18 to have been positioned axially to mutually abut shoulders 78 and 86. This leaves the entire neck 68 protruding from bobbin 46. Coil assembly 18 is retained in this position by providing larger diameter portion 88 of bobbin through-hole 84 to have a press-fit with larger outside diameter portion 80 of tube 12 where they mutually axially overlap when shoulders 78 and 86 are in mutual abutment. The nature of the press-fit is not so tight as to prevent the shoulders 78, 86 from being abutted, thus providing a limit stop that limits the insertion of the inlet tube 12 into bobbin 46, but it is sufficiently tight to prevent relative movement of the two parts while further processing of the fuel injector is being performed. FIG. 3 shows some of that further processing.

Since neck 68 is clear of coil assembly 18, neck 66 of part 26 can be telescoped onto it and the telescoped parts joined to each other, preferably laser welded together. The welds are portrayed by the reference numerals 94, 96. The welds extend around the full circumference of the parts and create hermetic, fluid-tight joints that are not in the fuel path through the fuel injector. Such placement of the welds avoids the possibility that they might introduce contamination into the fuel that could impair fuel injector performance. Weld 94 joins the free distal end of neck 66 with the external shoulder of inlet tube 12 adjoining the proximal end of neck 68. Weld 96 joins the I.D. end edge of rim 71 to the outside corner edge of part 26 defined by the juncture of the upper surface of shoulder 69 and the outer surface of rim 70. The O.D. of neck 66 is flush with the O.D. of tube 12 immediately above neck 68 so that after the welds have been created, coil assembly 18 can be slid axially on tube 12 from the FIG. 3 position to the FIG. 4 position, the press-fit not being so tight as to require an undue amount of force in order to break it.

Figure 4:
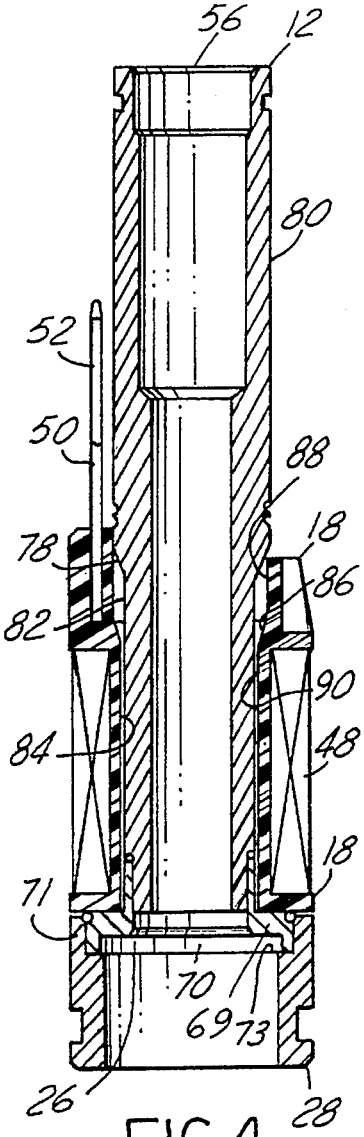

In the latter position, the lower bobbin flange and shoulder 69 mutually abut, and it can be appreciated that this abutment serves to properly axially position coil assembly 18 in a desired final position on tube 12 the same as shown in FIG. 1 where the telescoped necks 66, 68 including weld 94, are disposed within smaller diameter portion 90 of bobbin through-hole 84. Coil assembly 18 is kept in this position covering the entire joint comprising the telescopically engaged necks 66, 68 and weld 94 by placing housing 34 over the parts as they appear in FIG. 4 and welding it in place as at 74 for example in FIG. 1, although housing 34 is itself not shown in FIG. 4. As can be seen in FIG. 1, the upper end of housing 34 is shaped to axially trap coil assembly 18 against shoulder 69. FIG. 4 depicts what is sometimes called a power group before the power group is completed by subsequently forming terminals 50, 52 to final shape and injection molding overmold cover 36. Valve body part 30 and certain other parts associated with it form what is sometimes called a valve group, and final assembly of the fuel injector comprises assembling the valve group and the power group together, with the various internal parts such as spring 20, armature 22, and needle valve 24 being contained internally within the two assembled groups, and then placing shell 32 and then O-ring 44 over the nozzle end to the positions shown. Assembly of the valve group and the power group includes joining the two valve body parts together to form a fluid-tight joint between them, such as by a circumferential laser weld in the region where they overlap.

While a presently preferred embodiment of the invention has been illustrated and described, it is to be appreciated that principles of the invention apply to all equivalent constructions that fall within the scope of the following claims.

What is claimed is:

1. In an electrically operated fuel injector having a valve group and a power group, the power group comprising:

a coil assembly for generating electromagnetic forces;

a magnetic tubular stator having one end adapted for receiving fuel into the injector and forming a passageway for conducting fuel through said power group and out said other end to the valve group, said stator having a tubular neck at the other end of said stator juxtaposed said armature, said stator mounting said coil assembly;

a stepped non-magnetic shell having a tubular neck with a first inner diameter equal to said tubular neck inner diameter of said stator and telescopically fitted therein and a first outer diameter equal to the outer diameter of said stator, said shell having an axially extending first circular rim connected to said first outer diameter by means of a shoulder radially extending from said first outer diameter;

a magnetic tubular first valve body means axially extending from said first circular rim, said valve body means having a second circular rim at the end adjacent said circular rim of said shell terminating in a shoulder radially extending toward the axis of said tubular body for overlapping said first circular rim of said shell a magnetic second valve body means operative connected to the valve group and located in said first valve body means and encircling said armature, said second valve body means including a non-magnetic armature guide means;

hermetic weld means for forming said stator, said shell, said first body means and said second body means into an unitary structure, wherein said one end of said armature is parallel to the other end of said stator; and said armature guide means being axially displaced in the direction of said second valve body means from said overlapping shell and first body means.

2. The power group of a fuel injector as set forth in claim 1 wherein said hermetic weld between said stator and said shell comprises a circumferential laser weld at said end of said neck, and in that said fluid tight joint hermetic weld between said shell and said first valve body means is provided by a circumferential laser weld at said shoulder.

3. The power group of a fuel injector as set forth in claim 1 wherein the axial end of said first circular rim being disposed radially outward of said neck and extending axially from said shoulder, said rim having an axially facing end surface that is in abutment with said internal shoulder of said first valve body structure.

4. The power group of a fuel injector as set forth in claim 3 wherein said hermetic weld between said stator and said shell comprises a circumferential laser weld at said end of said neck and joining said neck to said stator, and in that said hermetic weld between said shell and said first valve body means is provided by a circumferential laser weld at the end said shoulder of said first circular rim.

5. The power group of a fuel injector as set forth in claim 1 wherein said hermetic weld between said first valve body means and said second valve body means comprises a circumferential laser weld at the axial end of said first valve body joining said first body means to the outside surface and intermediate the ends of said second body means.

6. The power group of a fuel injector as set forth in claim 1 wherein said hermetic weld means is located on the surfaces of said stator, said shell, said first valve body means and said second valve body means that are not in contact with the fuel in the injector.

7. The power group of a fuel injector as set forth in claim 1 wherein said coil assembly comprises a plastic bobbin having a central through-hole with a frustoconical shoulder dividing said through-hole into a large diameter portion and a small diameter portion, an electromagnetic coil wound on said bobbin, said stator has a frustoconical shoulder intermediate its ends for dividing said stator into a large diameter portion and a small diameter portion, said frustoconical shoulders being complimentary and said through-hole and said stator adapted for relative movement and having a press fit between the surface of the small diameter of said stator and said small diameter of said through-hole.

8. The power group of a fuel injector as set forth in claim 7 wherein said large diameter portion of said stator is adjacent said one end receiving fuel into the injector.

9. The power group of a fuel injector as set forth in claim 7 wherein the frustoconical shoulder of said stator and the frustoconical shoulder said bobbin abut each other prior to hermetic welding of said shell to said stator.

10. The power group of a fuel injector as set forth in claim 9 wherein said bobbin is adapted to abut said shoulder of said shell, said bobbin being in a press fit relationship with said stator when said bobbin abuts said shoulder.

11. A method of assembling a power group of a fuel injector comprising the steps of:

winding a coil on a bobbin with a through-hole;

mounting said bobbin through-hole on a magnetic tubular stator having one end adapted for receiving fuel into the injector and forming a passageway for conducting fuel through said power group and out said other end to the valve group, said stator having a tubular neck at the other end of said stator juxtaposed said armature;

telescoping said stator into a stepped non-magnetic shell having a tubular neck with a first inner diameter equal to said tubular neck inner diameter of said stator and telescopically fitted therein and a first outer diameter equal to the outer diameter of said stator, said shell having an axially extending first circular rim connected to said first outer diameter by means of a shoulder radially extending from said first outer diameter;

telescoping said first circular rim of said shell into a magnetic tubular first valve body means axially extending from said first circular rim, said valve body means having a second circular rim at the end adjacent said circular rim of said shell terminating in a shoulder radially extending toward the axis of said tubular body for overlapping said first circular rim of said shell inserting a magnetic second valve body means operative connected to the valve group and located in said first valve body means, said second valve body means including a non-magnetic armature guide means; and then hermetically welding said stator, said shell, said first body means and said second body means into an unitary structure, wherein said one end of said armature is parallel to the other end of said stator.

12. A method of assembling a power group of a fuel injector as set forth in claim, 11, wherein in the step of mounting said coil assembly on said stator includes the steps of forming complimentary frustoconical shoulders on said stator and said through-hole in the bobbin.

13. A method of assembling a power group of a fuel injector as set forth in claim 12 wherein before the step of welding, additionally include the step of relatively sliding said bobbin on said stator for abutting said frustoconical shoulders in a pressed fit relationship.

14. A method of assembling a power group of a fuel injector as set forth in claim 13 wherein after the step of welding, additionally include the step of relatively sliding said coil assembly on said stator for abutting said bobbin of said coil assembly against the shoulder of said shell in a pressed fit relationship.

* * * * *